United States Patent [19]

Slater

[11] Patent Number: 4,705,275

[45] Date of Patent: Nov. 10, 1987

[54] DOMINO CARRYING CASE, GAMEBOARD AND GAME PIECE TURNING AND SHUFFLING DEVICE

[75] Inventor: Frank W. Slater, Durant, Okla.

[73] Assignee: Southeastern Research and Development, Inc., Durant, Okla.

[21] Appl. No.: 844,171

[22] Filed: Mar. 26, 1986

[51] Int. Cl.[4] ..... A63F 9/20

[52] U.S. Cl. ..... 273/309; 206/315.1; 273/148 R

[58] Field of Search ..... 273/149 R, 285, 148 R, 273/309; 206/315.1

[56] References Cited

U.S. PATENT DOCUMENTS 4,421,312 12/1983 Delgado et al. ..... 273/287 X 4,513,974 4/1985 Lin ..... 273/284 X

FOREIGN PATENT DOCUMENTS 1436453 5/1976 United Kingdom ..... 273/285

*Primary Examiner*—Anton O. Oechsle

*Attorney, Agent, or Firm*—Fleit, Jacobson, Cohn & Price

[57] ABSTRACT

A pair of closely spaced juxtaposed first and second panels including relatively straight and parallel corresponding marginal edge portions are provided. An elongated narrow strip panel extends longitudinally along, transversely between and joined to the parallel marginal edge portions of the first and second panels by integral "living" hinges. Marginal walls or curbs are supported from one of the first and second panels and extend between the latter. The spacing between the first and second panels is slightly greater than the thickness of a domino game piece and the panels are swingable to positions coextensive with the narrow strip panel.

9 Claims, 5 Drawing Figures

FIG. 1
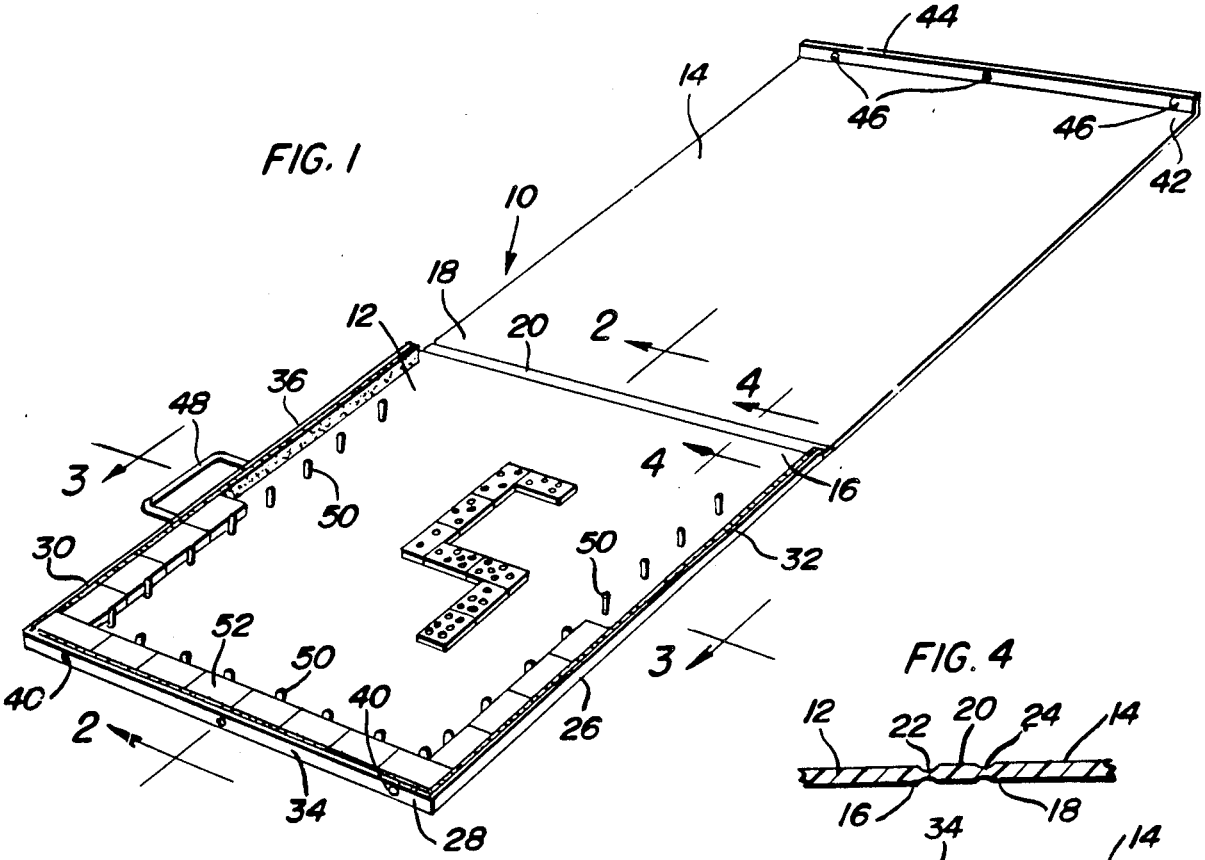
FIG. 4
FIG. 5
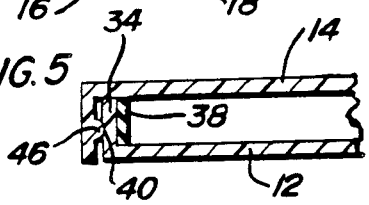
FIG. 2
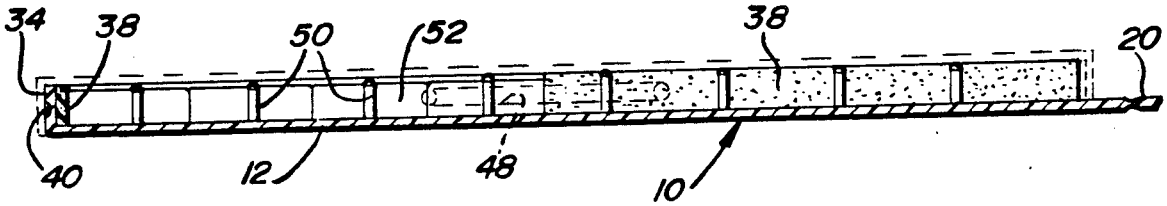
FIG. 3
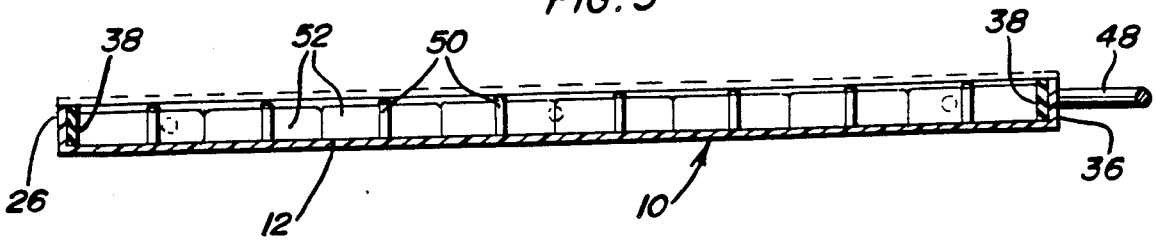

DOMINO CARRYING CASE, GAMEBOARD AND GAME PIECE TURNING AND SHUFFLING DEVICE

BACKGROUND OF THE INVENTION

1. Field of the Invention

This invention relates to a special receptacle for amusement game pieces and incorporates structure defining a playing surface for the game pieces in addition to structure enabling a plurality of game pieces to be readily inverted and randomly mixed relative to the playing surface.

2. Description of Related Art

Various different forms of gameboards, containers and other similar devices including some of the general structural and operational features of the instant invention are disclosed in U.S. Pat. Nos. 840,558, 1,221,493, 1,519,389, 3,080,087, 3,130,973, 3,784,205 and Great Britain No. 1,436,453. However, these previously known structures do not include the combination of structural features of the instant invention which enables game pieces such as domino game pieces to be simultaneously turned from a face-up position to a face-down position relative to a playing surface.

SUMMARY OF THE INVENTION

A carrying case for domino game pieces and the like is provided incorporating a pair of closely spaced juxtaposed first and second panels including relatively straight and parallel corresponding marginal edge portions between which an elongated narrow strip panel extends having opposite side longitudinal edges from which said marginal edge portions are pivotally mounted. The first panel includes an outwardly projecting peripheral curb extending toward and abutting against the second panel throughout those peripheral portions of the first and second panels exclusive of the aforementioned marginal edge portion thereof and a plurality of game pieces, such as domino game pieces, are loosely disposed between the first and second panels with the opposite front and rear faces of the game pieces opposing the first and second panels. The panels may be relatively angularly displaced to positions with the first and second panels coextensive with the narrow strip panel and the game pieces may be slid from one of the first and second panels, across the strip panel and onto the other of the first and second panels. Furthermore, the spacing between the first and second panels, when disposed in juxtaposed positions, is insufficient to allow the game pieces to turn from positions with the front and rear faces thereof opposing the first and second panels.

The main object of this invention is to provide an apparatus which may comprise a carrying case and gameboard for game pieces such a dominoes.

Another important object of this invention is to provide an apparatus in accordance with the preceding object and including structure by which the game pieces may be readily shuffled.

A further important object of this invention is to provide an apparatus apparatus as above described wherein the domino game pieces may be simultaneously turned from face-up to face-down positions on the playing surface.

Still another object of this invention is to provide an apparatus in accordance with the preceding objects and designed in such a manner whereby the basic structure thereof may be of one-piece construction.

Another object of this invention is to provide an apparatus whose structural features lend themselves well to being constructed of durable plastic materials.

A final object of this invention to be specifically enumerated herein is to provide an apparatus in accordance with the preceding objects and which will conform to conventional forms of manufacture, be of simple construction and easy to use so as to provide a device that will be ecomically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the multi-function apparatus of the instant invention with the two major panel portions thereof and the attendant narrow strip panel in coplanar relation;

FIG. 2 is a fragmentary enlarged vertical sectional view taken substantially upon the plane indicated by the section line 2—2 of FiG. 1;

FIG. 3 is an enlarged vertical sectional view taken substantially upon the plane indicated by the section line 3—3 of FIG. 1;

FIG. 4 is an enlarged fragmentary vertical sectional view taken substantially upon the plane indicated by the section line 4—4 of FIG. 1; and FIG. 5 is a fragmentary enlarged vertical sectional view illustrating the latch structure by which the carrying case is retained in the closed position.

DESCRIPTION OF THE PREFERRED EMBODIMENT

Referring now more specifically to the drawings, the numeral 10 generally designates a multiple game piece carrying case, gameboard and game piece turning and shuffling device. The device 10 includes a pair of large first and second panels 12 and 14 of generally rectangular plan shape. The panels 12 and 14 are illustrated in FIG. 1 as being in slightly spaced coplanar relation including one pair of adjacent corresponding marginal edges 16 and 18. A narrow elongated strip panel 20 is disposed between and formed integrally with the panels 12 and 14 and the opposite side longitudinal marginal edges of the strip panel 20 are straight and are joined to the straight parallel marginal edges 16 and 18 of the panels 12 and 14 by reduced thickness zones 22 and 24 defining "living hinges". The panels 12, 14 and 20 as well as the zones 22 and 24 are formed of the same plastic material. However, it is to be noted that the strip panel 20 could be hingedly mounted between the panels 12 and 14 by well known means other than the reduced thickness zones 22 and 24.

The panel 12 includes marginal portions 26, 28 and 30 in addition to the marginal edge 16 and the marginal portions 26, 28 and 30 include upstanding curbs or retaining walls 32, 34 and 36, respectively, extending longitudinally therealong. The inner surfaces of the curbs 32, 34 and 36 have resilient strips 38 secured thereover for a purpose to be hereinafter more fully set forth. In addition, the curb 34 includes three detent recesses 40 on its outer surface spaced longitudinally therealong and the marginal edge 42 of the second panel 14 includes a right angle integral flap 44 supported therefrom including three detent projections 46 spaced therealong and projecting outwardly over the panel 14. Also, the curb 36 includes a bail-type handle 48 mounted therefrom on the exterior thereof.

The second panel 14 is swingable from the position thereof illustrated in FIG. 1 into position overlying the first panel 12 in vertical registry therewith and with the strip panel 20 disposed at substantially right angles to the panel 12 and 14. The marginal portions of the second panel 14 corresponding to the marginal portions 26, 28 and 30 of the panel 12 abut the coplanar upper edges of the curbs 32, 34 and 36 to support the second panel 14 in position slightly spaced above the first panel 12 and in position paralleling the latter, the effective width of the strip panel 20 being equal to the effective height of the curbs 32, 34 and 36. In addition, when the panel 14 is swung into position overlying the panel 12 and supported from the curbs 32, 34 and 36, the flap 40 swings downward over the outer side of the curb 34 and the detent projections 46 are seated in the detent recesses 40 snap-latching the panel 14 in the closed position.

The curbs 32 and 36 extends substantially the full length of the marginal portions 26 and 30 and at least substantially abut the opposite ends of the strip panel 20 when the second panel 14 is latched in the closed position.

Each of the marginal portions 26, 28 and 30 includes a row of upright pegs 50 extending therealong and spaced inward from the corresponding outer marginal edge, associated curb and resilient strip 38. The rows of pegs 50 are spaced a predetermined distance from the corresponding curbs equal to the transverse width of a domino game piece 52. Accordingly, when desired, domino game pieces may be lined up along each of the marginal portions 26, 28 and 30 in lengthwise aligned positions between the pegs 50 and the corresponding curbs for support of the dominos 52 in substantially stationary positions. The domino game pieces 52 are of a length greater than the width thereof and each domino piece is of a thickness less than its width. Further, the thickness of each domino piece is slightly less than the spacing between the panels 12 and 14 when the panel 14 is in the closed position and the effective height of the pegs or uprights 50 is substantially equal to the spacing between the panels 12 and 14 when the panel 14 is in the closed position.

When it is desired to play a game of dominoes, the device 10 is opened to the position thereof illustrated in FIG. 1 and, assuming that the dominoes 52 are all inward of the pins 50 in face down positions, the persons to play the game of dominoes select the proper number of dominoes they are to use in playing the game. Conventionally, the dominoes selected will be placed on edge facing each player and may be positioned between the pins 50 and the corresponding curbs. Then, the "hand" of dominoes commences. After the "hand" has been completed and all of the dominoes 52 are in face up positions on the panel 12 and it is desired to turn the domino pieces 52 to face downward positions and to shuffle the domino pieces 52, the panel 14 is swung to the closed position, the device 10 may be oscillated in a horizontal plane to shuffle the domino pieces 52 between the rows of pins 50 and the device 10 may be inverted to a position with the panel 14 lowermost and thereafter opened. The domino pieces 42 will then be disposed on the panel 14 in a face downward position and the face downward dominoes may either be chosen by the players from the panel 14, or may first be slid across the strip panel 20 and onto the panel 12 before being chosen by the individual game players.

On the other hand, after the completion of a domino game "hand", the domino pieces in face-up position may be slid across the strip panel 20 and onto the second panel 14 in face-up position. Then, the panel 12 may be swung into position over the panel 14 and the device 10 may then be inverted back to a position 12 lowermost while the device 10 is closed. Shuffling of the dominoes 52 may be accomplished either when the panel 12 is first swung into position over the panel 14 or after the device 10 has been inverted back to a position with the panel 12 lowermost and before the panel 14 is swung to the open position. This, of course, will result in the domino pieces 52 being shuffled and disposed in face-downward position upon the first panel 12 when the second panel 14 is swung to the open position preparatory to commencing the next "hand" of the dominoes game.

Inasmuch as the dominoes or game pieces 52 are tightly received between the pins 50 and the resilient strips 38, all of the dominoes 52 may be positioned within the device 10 when the latter is closed without the dominoes rattling around inside the device 10. Further, the spacing between adjacent pins 50 is insufficient to enable domino game pieces being shuffled between the pins 50 to be seated between the pins 50 and the resilient strips 38. The domino pieces 52 are receivable between the pins 50 and the corresponding resilient strips 38 only from above.

In addition, it is pointed out that inasmuch as the spacing between the opposing panels 12 and 14 is only slightly greater than the minimum thickness dimension of the domino game pieces 52, the latter cannot be turned from either face-up or face-down positions when the panel 14 is in the closed position. Accordingly, when the panel 14 is in the closed position, the device 10 may be horizontally omnidirectionally oscillated in order to effect shuffling of the domino game pieces between the pins 50 without any of the dominoes turning from face-up or face-down positions to face-down and face-up positions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game piece carrying case, gameboard and game piece turning and shuffling device including a pair of large plan area first and second parallel panels disposed in closely spaced juxtapositions and including one pair of generally straight and parallel corresponding marginal edges, an elongated narrow strip panel extending longitudinally along and transversely between said edges and including opposite side longitudinal edges to which said marginal edges are hingedly anchored for swinging of said first and second panels from said juxtapositions to positions coextensive with said strip panel, at least one of said large plan area panels including peripheral curb means extending outwardly therefrom toward the other large panel substantially throughout the peripheral portions thereof exclusive of said one pair of corresponding marginal edges, a plurality of opposite front and rear face equipped game playing pieces loosely receivable in face-down positions between said panels when the latter are in said juxtapositions, the thickness of said pieces, measured between said faces, being the minor dimensions of said pieces and only slightly less than the spacing between said panels, whereby the spacing between said panels is insufficient to allow random turning of said pieces from one face-down position to the opposite face-down positions, said pieces being freely slidable from positions disposed on one said large plan area panel, across said strip panel and onto the other large plan area panel when said large plan area panels are coextensive with said strip panel, said curb means functioning to establish a minimum spaced parallel relationship between said large cross-sectional area panels and to prevent movement of said playing pieces outwardly of said peripheral portions from between said large plan area panels.

2. The device of claim 1 wherein said peripheral portions of said one large plan area panel include rows of outstanding pins supported therefrom spaced inwardly from the corresponding curb means and between which rows of pins and corresponding curb means said game pieces may be snugly received.

3. The device of claim 2 wherein the effective length of said pins is less than the spacing between said large planning area panels when the latter are in said juxtapositions.

4. The device of claim 2 wherein the inner sides of curb means include thin resilient strips extending therealong between said curb means and said rows of pins.

5. The device of claim 1 including outstanding handle means carried by one said curb means.

6. The device of claim 1 including coacting latch means carried by said large plan area panels operative to releasably retain said panels in said juxtapositions.

7. The device of claim 1 wherein said peripheral portions of said one large plan area panel include rows of outstanding pins supported therefrom spaced inwardly from the corresponding curb means and between which rows of pins and corresponding curb means said game pieces may be snugly received, said pins being spaced along said rows on centerpoints spaced apart a distance substantially equal to the length of said game pieces.

8. The method of turning domino game pieces to random face-down positions on a first horizontal game panel from face-up positions on said panel preparatory to game participants selecting their game pieces to be played in a subsequent domino game "hand", said method including:

A. providing a second panel having one marginal edge thereof hinged to a corresponding marginal edge of said first panel through the utilization of an intermediate elongated narrow strip panel extending longitudinally along and disposed between said one and corresponding marginal edges and with said one and corresponding marginal edges of said game panel and second panel supported from the opposite side longitudinal edges of said strip panel for relative swinging of said game and second panels between parallel juxtapositions spaced from each other approximately the width of said strip panel between said opposite side longitudinal edges thereof and second positions generally coextensive with said strip panel;

B. sliding said face-up game pieces from said first game panel, across said strip panel and onto said second panel when said panels are in said generally coextensive positions;

C. swinging said first panel toward a position over said second panel with said panels in said juxtapositions and said second panel lowermost;

D. horizontally shaking said panels in unison while maintaining said pieces within the peripheral confines of said first and second panels to "random" mix said pieces;

E. simultaneously inverting said first and second panels, in unison to positions with said first and second panels remaining in said juxtapositions and while maintaining said pieces within the peripheral confines of said first and second panels; and F. relatively swinging said second panel to a position with said first and second panels coextensive with said strip panel and while maintaining said first panel substantially horizontal.

9. The method of turning domino game pieces to random face-down positions on a first horizontal game panel from face-up position on said game panel preparatory to game participants selecting their game pieces to be played in a subsequent domino game "hand", said method including:

A. providing a second panel having one marginal edge thereof hinged to a corresponding marginal edge of said panel through the utilization of an intermediate elongated narrow strip panel extending longitudinally along and transversely between said first and second panels and with the corresponding marginal edges of said first and second panels hingedly supported from the opposite side longitudinal edges of said strip panel for relative swinging of said first and second panels between parallel juxtapositions spaced from each other approximately the width of said strip panel between the opposite side longitudinal edges thereof and second positions generally coextensive with said strip panel;

B. sliding said face-up game pieces from said first panel, across said strip panel and onto said second panel when said first and second panels are coextensive with said strip panel;

C. swinging said first panel toward a position over said second panel with said panels in said juxtapositions and said second panel lowermost;

D. simultaneously inverting said first and second panels, in unison, to positions with said panels remaining in said juxtapositions and with said first panel lowermost and while maintaining said game pieces within the peripheral confines of said first and second panels;

E. horizontally shaking said panels, in unison, while maintaining said pieces within the peripheral confines of said first and second panels to "random mix" said pieces; and F. relatively swinging said second panel to a position coextensive with said first panel and strip panel while maintaining said first panel substantially horizontal.

* * * * *